US007011219B2

(12) United States Patent
Knox-Holmes et al.

(10) Patent No.: US 7,011,219 B2
(45) Date of Patent: Mar. 14, 2006

(54) EROSION-RESISTANT HYDROCYCLONE LINER

(75) Inventors: Brent R. Knox-Holmes, East Farndon (GB); John Kingsley, Bewdley (GB)

(73) Assignee: Petreco International, Ltd., Rugby (GB)

( * ) Notice: Subject to any disclaimer, the term of this patent is extended or adjusted under 35 U.S.C. 154(b) by 264 days.

(21) Appl. No.: 10/612,691

(22) Filed: Jul. 2, 2003

(65) Prior Publication Data

US 2005/0016904 A1 Jan. 27, 2005

(51) Int. Cl.
*B03B 5/34* (2006.01)

(52) U.S. Cl. ..... 209/725; 209/727; 209/715; 209/722

(58) Field of Classification Search ..... 209/725, 209/727, 715, 722
See application file for complete search history.

(56) References Cited

U.S. PATENT DOCUMENTS

| | | | | |
|---|---|---|---|---|
| 3,136,723 A | | 6/1964 | Erwin et al. | |
| 3,988,239 A | * | 10/1976 | Malina | 55/435 |
| 4,053,393 A | * | 10/1977 | Day et al. | 55/435 |
| 4,208,270 A | | 6/1980 | Grieve et al. | |
| 4,539,105 A | | 9/1985 | Metcalf | |
| 4,541,934 A | * | 9/1985 | Hakola | 210/787 |
| 5,110,471 A | * | 5/1992 | Kalnins | 210/512.2 |
| 5,972,141 A | * | 10/1999 | Ellyin | 156/94 |
| 6,354,334 B1 | * | 3/2002 | Ellyin et al. | 138/143 |
| 2001/0002009 A1 | * | 5/2001 | Gil et al. | 210/512.1 |

FOREIGN PATENT DOCUMENTS

| | | |
|---|---|---|
| EP | 1 136 132 | 9/2001 |
| GB | 2 214 841 | 9/1989 |

* cited by examiner

*Primary Examiner*—Donald P. Walsh
*Assistant Examiner*—Kaitlin Joerger
(74) *Attorney, Agent, or Firm*—Madan, Mossman & Sriram P.C.; Peter Bielinski

(57) ABSTRACT

Erosion-resistant liquid/liquid hydrocyclone liners, wherein the weight and cost of the liners are kept within acceptable parameters through the construction of a composite hydrocyclone liner, comprised of two or more different materials. The hydrocyclone liner includes a head section that is fashioned, primarily, of a highly erosion-resistant material, such as tungsten carbide. The liner also includes a separate separation section that is primarily fashioned of a material that may be less erosion-resistant but which is less brittle and more physically durable than that used to construct the head section. As a result of this composite construction, the liner is less likely to fail mechanically during installation or use. The head and separation sections are removably affixed to one another. The separation section of the hydrocyclone liner is provided with one or more structural supports to provide mechanical strength and resistance to bending. A liner is also described having a removable involute insert of highly erosion resistant material.

27 Claims, 6 Drawing Sheets

EROSION-RESISTANT HYDROCYCLONE LINER

BACKGROUND OF THE INVENTION

1. Field of the Invention

The invention relates generally to an improved hydrocyclone liner composed of a combination of materials, especially liquid-liquid liners used for petroleum fluid processing.

2. Description of the Related Art

The overall construction and manner of operation of hydrocyclone liners is well known. A typical hydrocyclone liner, also referred to as merely a "hydrocyclone," includes an elongated body surrounding a tapered separation chamber of circular cross-section, which separation chamber decreases in cross-sectional size from a large overflow and input end to a narrow underflow end. An overflow or reject outlet for the lighter fraction is provided at the wider end of the conical chamber while the heavier underflow or accept fraction of the suspension exits through an axially arranged underflow outlet at the opposite end of the conical chamber. Liquids and suspended particles are introduced into the chamber via one or more tangentially directed inlets, which inlets create a fluid vortex in the separation chamber. The centrifugal forces created by this vortex throw denser fluids and particles in suspension outwardly toward the wall of the conical separation chamber, thus giving a concentration of denser fluids and particles adjacent thereto, while the less dense fluids are brought toward the center of the chamber and are carried along by an inwardly-located helical stream created by differential forces. The lighter fractions are thus carried outwardly through the overflow outlet. The heavier particles continue to spiral along the interior wall of the hydrocyclone liner and exit the liner via the underflow outlet.

The fluid velocities within a hydrocyclone liner are high enough that the dynamic forces produced therein are sufficiently high to overcome the effect of any gravitational forces on the performance of the device. Hydrocyclone liners may, therefore, be arranged in various physical orientations without affecting performance. Hydrocyclone liners, especially those for petroleum fluid processing, are commonly arranged in large banks of several dozen or even several hundred hydrocyclone liners with suitable intake, overflow and underflow assemblies arranged for communication with the intake, overflow and underflow openings, respectively, of the hydrocyclone liners.

Hydrocyclone liners are used both for the separation of liquids from solids in a liquid/solid mixture ("liquid/solid hydrocyclones") as well as for the separation of liquids from other liquids ("liquid/liquid hydrocyclones"). Different constructions are used for each of these hydrocyclone devices. The liquid/liquid type of hydrocyclone liner is longer in the axial direction than a solid/liquid hydrocyclone liner and is thinner as well. As a result of these structural differences, the engineering of a liquid/liquid hydrocyclone liner that is both erosion-resistant and which can support its own weight is challenging.

It is noted that erosion resistance has heretofore not been considered as important a design consideration for liquid/liquid hydrocyclone liners as for liquid/solid hydrocyclone liners, since liquid/solid hydrocyclones have been expected to experience greater wear due to the large amount of solids present in the material being separated. Liquid/liquid hydrocyclones, by contrast, are considered to have no or very little solids content and, therefore, erosion is less of a concern.

Conventionally, then, liquid/liquid hydrocyclone liners have been designed for optimal corrosion resistance, assuming either no or very little erosion, and then later discarded or repaired in the event of erosion damage to the liners. In fact, however, erosion of liquid/liquid hydrocyclones is a serious problem in certain installations. Impurities in the form of solid particles are suspended in the liquids to be separated. The inventors have recognized that these solid particles are capable of causing tremendous erosion of the hydrocyclone liner, particularly upon those portions of the liner that experience high rotational fluid forces. Thus, an improved erosion-resistant liquid/liquid hydrocyclone liner would be desirable.

Normally, hydrocyclone liners for separating fluids are made from one or more homogeneous materials. When increased resistance to erosion is required (due to entrained solids in the fluids), the current practice is to simply substitute the original material of the liner for an erosion-resistant material, such as alumina ceramic or tungsten carbide. If the diameter of the hydrocyclone liner is large enough, such as for solid-liquid separating liners, it may be possible to spray an erosion-resistant coating into the bore of the liner. Repeated spraying of such coating allows a longer life for the liner. This is not generally an available option for narrow bore liquid/liquid liners, such as is used in petroleum fluid processing. Access to the interior surfaces of the liner is limited due to the small diameter (typically less than 2") of portions of the liner, and the length of the liner makes an even and complete coating unlikely. Further, only a limited number of suitable coating treatments are known that will harden the steel of the liner against erosion without compromising its corrosion resistant properties.

Erosion-resistant materials, such as ceramics or certain alloys, may be very heavy or brittle, such that the construction of the entire liner from such erosion-resistant material is not desirable. For example, tungsten carbide, a common erosion-resistant material, is twice as dense as steel. A hydrocyclone liner comprised entirely of an erosion-resistant material, such as tungsten carbide, might not be fit for service due to poor mechanical properties (including weight and tensile strength) and high cost. Liquid/liquid hydrocyclone liners are typically installed horizontally, being supported by a support plate at either end. Depending on the mode of installation, the liners may be left cantilevered from one support plate, with the liner having to take the weight of the head casting, while the second support plate is moved into position. Also, installation may require that a liner be physically hammered into place in the first support plate. During installation, then, a heavy and brittle liner might easily be damaged. As petroleum fluid processing is often located in shipboard installations or on off-shore platforms, a highly reliable and relatively lightweight hydrocyclone liner is desired.

A few designs are known for erosion-resistant hydrocyclones and hydrocyclone liners. For one reason or another, however, these prior art designs are unsatisfactory and/or do not provide an acceptable design for an erosion resistant liquid/liquid hydrocyclone liner.

U.S. Pat. No. 4,053,393 issued to Day et al., for example, describes a cyclone assembly for separation of fluids of different densities that includes an erosion-resistant insert body that is disposed within the diametrically smaller end of the hydrocyclone liner body. This liner body, according to Day et al., is formed of a synthetic plastic material, while the insert body may be formed of various metals, ceramics, synthetic materials of various hardness's, or natural and synthetic elastomers. The insert body is retained within the liner body by a series of annular shoulders that interlock with complimentary shoulders on the liner body.

The Day et al. design does not provide adequate erosion protection for the inner surfaces associated with the inlet portion of the hydrocyclone because the erosion protection is only provided at and around the reduced diameter portion of the hydrocyclone. However, the velocity of particles entering the hydrocyclone at the inlet portion does result in significant erosion at and near the inlet portion. Day et al.'s design does nothing to prevent or slow this erosion.

U.S. Pat. No. 4,539,105 issued to Metcalf illustrates a cyclone separator that includes an outer plastic sleeve that houses an interior separator cone made of abrasion resistant material, that may include metal, such as stainless steel, or ceramic material, such as aluminum oxide ceramic material, or silicone carbide ceramic.

Metcalf's liner design is intended for, and indeed only suitable for, solid/liquid hydrocyclones. Specifically, the design is intended for use where the mixture entering the hydrocyclone contains a heavy fractional material, such as solid particles of sand, or pulp stone grit of aluminum oxide or silicon carbide, such as when the stock is a solution of paper pulp formed by pulp stone grinding. As noted, a liquid/liquid hydrocyclone is configured differently from a solid/liquid hydrocyclone, such as that described in the Metcalf patent, at least in that the wider, inlet end and tapered portion of a liquid/liquid hydrocyclone is much narrower and longer than the inlet end and tapered portions of the solid/liquid hydrocyclone. For example, the wider end of a solid/liquid hydrocyclone is typically about 1500 mm in diameter, as compared with 20–40 mm for a liquid/liquid hydrocyclone. This difference in dimensions ensures that Metcalf's design is unsuitable for liquid/liquid hydrocyclones. The weight and strengths of the materials involved make it unlikely that a narrower liquid/liquid hydrocyclone, constructed using Metcalf's described configuration, would be able to support its own weight and be robust enough to have a very long operational life.

It is desired to have a hydrocyclone liner for liquid-liquid separation, which liner is capable of withstanding the erosive effects of particles trapped within the liquids being separated.

It is further desired to have an erosion-resistant hydrocyclone liner that does not have significantly poorer physical characteristics than non-erosion-resistant liners. It is also desired to have a hydrocyclone liner that provides improved erosion-resistant characteristics for those specific portions of the liner that experience the greatest degree of erosion during use.

There is a need to provide improved methods and devices for resisting erosion of, and thereby extending the service life of, hydrocyclone liners. The present invention addresses the problems of the prior art.

SUMMARY OF THE INVENTION

The present invention is directed to improved erosion-resistant liquid/liquid hydrocyclone liners, wherein the weight and cost of the liners are kept within acceptable parameters through the construction of a composite hydrocyclone liner, comprised of two or more different materials. The erosion-resistant properties of materials such as tungsten carbide and ceramics are exploited by the invention through the use of one or more additional materials to support the erosion-resistant material. The inventors have recognized that hydrocyclone liners tend to suffer the most significant damage from erosion proximate the involute and fluid inlet portions of the hydrocyclone, where fluid velocities are generally the greatest and where a change in fluid direction from linear at the inlets to tangential in the wide end of the liner causes severe impact damage. In preferred embodiments, the inventive hydrocyclone liner includes a head section that is fashioned, primarily, of a highly erosion-resistant material, such as tungsten carbide. The liner also includes a separate separation section that is primarily fashioned of a material that may be less erosion-resistant but which is less brittle and more physically durable than that used to construct the head section. As a result of this composite construction, the liner is less likely to fail mechanically during installation or use. The head and separation sections are removably affixed to one another.

Those portions of the liner that would typically be subject to the greatest degrees of erosion are fashioned of a highly erosion-resistant material, such as tungsten carbide, silicon carbide, ceramic, or other materials of similar characteristics. In preferred embodiments, the wetted areas of the head portion are provided with an erosion-resistant coating.

The separation portion of the hydrocyclone liner is provided with one or more structural supports to provide mechanical strength and resistance to bending. In preferred embodiments, a structural support comprises an exterior sleeve formed of fiber-reinforced epoxy wherein the fibers within the epoxy are substantially aligned in an axial direction. In other embodiments, the separation section is formed of multiple separate components that are joined to one another by a tubular joint member. In still other embodiments, sprayed-on metals or other composites may provide structural supports. In yet other embodiments, the head section retains a removable involute insert that is formed of a highly erosion resistant material.

BRIEF DESCRIPTION OF THE DRAWINGS

For detailed understanding of the invention, reference is made to the following detailed description of the preferred embodiments, taken in conjunction with the accompanying drawings in which reference characters designate like or similar elements throughout the several figures of the drawings.

DETAILED DESCRIPTION OF THE PREFERRED EMBODIMENTS

Figure 1:
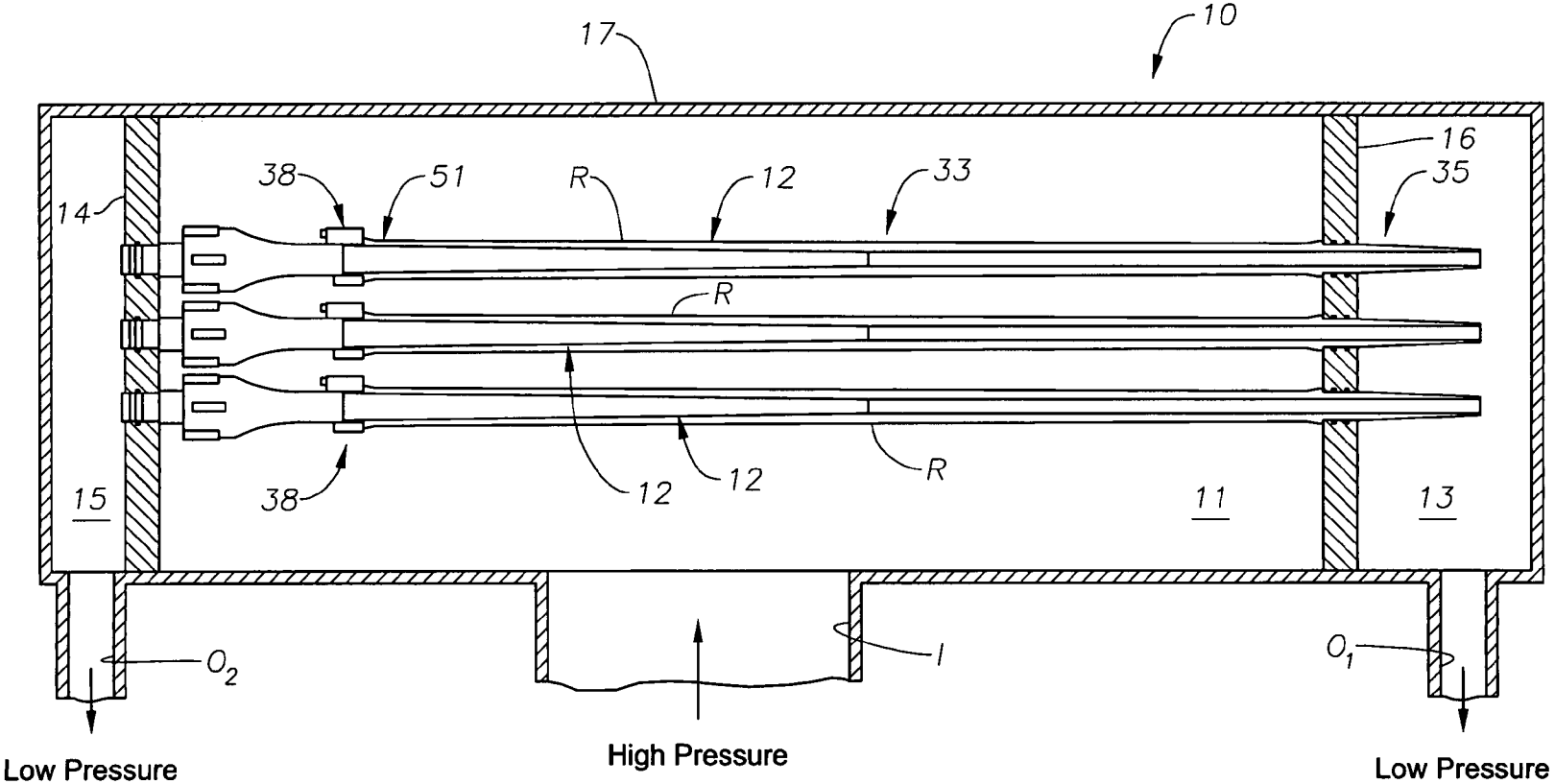
FIG. 1 is a side, cross-sectional view of portions of an exemplary hydrocyclone assembly for the separation of liquids in a liquid mixture.

FIG. 1 illustrates a portion of a hydrocyclone assembly 10, of a type known in the art, having a plurality of hydrocyclones, or liners, 12 that separate fluid components of a fluid mixture. Those of skill in the art will understand that the hydrocyclone assembly 10 includes numerous other components and systems that are not germane to the present invention and, therefore, are not described in any detail here. Two support plates 14 and 16, which are located proximate opposite ends of the hydrocyclones 12, support the hydrocyclones 12. The two support plates 14, 16 are installed within a hydrocyclone vessel 17 having a fluid inlet I, underflow outlet $O_1$ and reject outlet $O_2$. A fluid mixture enters the fluid inlet I into central chamber 11. Fluids separated by the hydrocyclones 12 are emptied into the underflow chamber 13 and reject chamber 15. As indicated by FIG. 1, a fluid mixture enters the inlet I under high fluid pressure, and there is lower fluid pressure proximate the respective outlets $O_1$, $O_2$. As the details of such separation vessels are well known, they will not be described further here.

Figure 2:
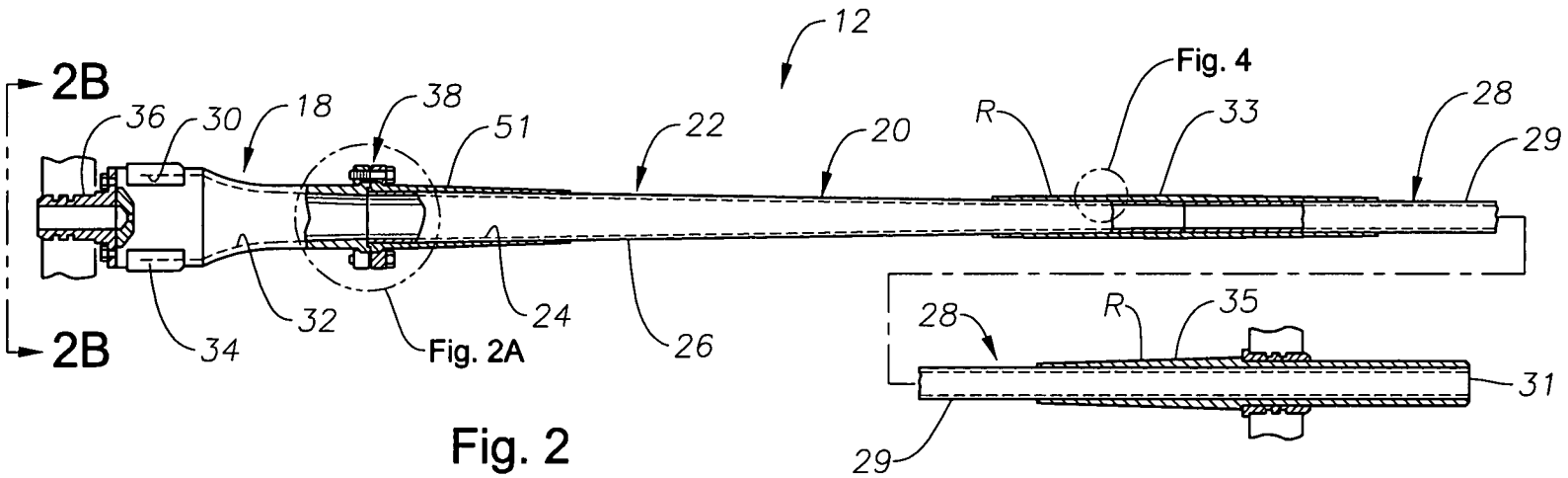
FIG. 2 is a side view, partially in cross-section, of an exemplary erosion-resistant liquid/liquid separation hydrocyclone used within the hydrocyclone assembly of FIG. 1 and constructed in accordance with the present invention.
Figure 2C:
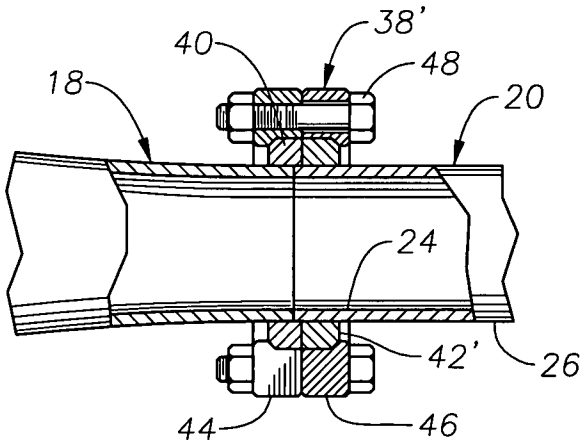
FIG. 2C is a side, cross-sectional detail depicting an alternative exemplary flange assembly used to secure the head section of a hydrocyclone to the separation portion.
Figure 2B:
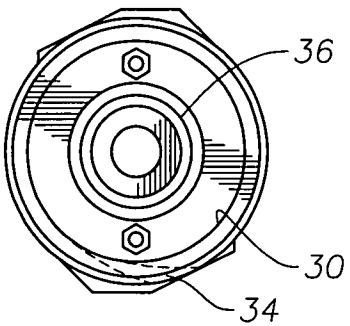
FIG. 2B is an end view of the hydrocyclone shown in FIG. 2.
Figure 2A:
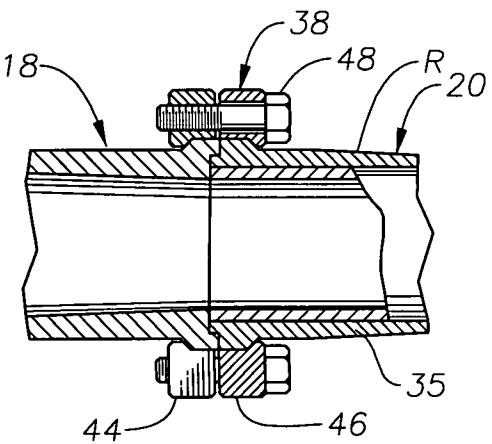
FIG. 2A is an enlarged side, cross-sectional view of the flange assembly portion of the hydrocyclone shown in FIG. 2.

FIGS. 2, 2A, and 2B illustrate a single exemplary tubular hydrocyclone 12 apart from other portions of the assembly 10 and constructed in accordance with the present invention. It is noted that the hydrocyclone 12 is a liquid/liquid hydrocyclone for the separation of a liquid from a mixture of liquids. The hydrocyclone 12 includes a generally cylindrical inlet, or head, section 18, and a separation section 20. The separation section 20 has an upper portion 22 that defines a separation chamber 24 having a sidewall 26, which is typically tapered, but in some models of hydrocyclone may not be tapered. A lower underflow portion 28, also referred to as the "tailpipe," extends from the upper portion 22. The underflow portion 28 has a sidewall 29 that is substantially the same diameter along the length of the underflow portion 28 and terminates in a downstream end 31. In operation, heavier liquids and separated solids, such as sand, are removed through the downstream end 31 of the underflow portion 28.

The head section 18 defines a generally cylindrical fluid chamber 30, known also as an involute, and a tapered portion 32 having a curved taper. It is preferred that at least the involute 30 and, preferably also the tapered portion 32, by formed of a material that is highly erosion resistant, as these areas tend to experience the greatest wear from erosion. A pair of rectangular inlets 34 (one shown in FIG. 2B) is associated with the fluid chamber 30 of the head section 18 for lateral injection of a liquid/liquid mixture into the fluid chamber 30. Also associated with the head section 18 is an overflow, or "reject" outlet 36.

Referring again to FIG. 2, the separation section 20 and underflow portion 28 of the hydrocyclone 12 are formed as a unitary piece and preferably fashioned of a material which is not as erosion-resistant as tungsten carbide, but is significantly less brittle. The outer surface of the separation section 20 is reinforced by reinforcement layer R, which preferably extends along the entire length of the searation section 20 and underflow portion 28. The reinforcement layer R provides reinforced portions, or structural supports, illustrated generally at 33, 35 and 51 in FIG. 2, which help preclude mechanical damage to the separation section 20 and underflow portion 28, primarily by bending. There are several different constructions for the separation section 20, the underflow portion 28 and the reinforced layer R, which will be described shortly.

In the embodiment depicted in FIGS. 2, 2A and 2B, the head section 18 is a separate component that is securely affixed to the separation section 20 by an annular flange assembly 38. FIG. 2A depicts an exemplary flange assembly 38 in greater detail. As can be seen there, the mating ends of the head section 18 and the separation section 20 are each provided with an annular, outwardly extending flange 44, 46, respectively. The flanges 44, 46 are preferably integrally formed with each component 18, 20 or, in the alternative, welded thereto or secured thereto using another secure connecting method. The flanges 44, 46 are shown to be securely affixed to one another by nut- and bolt assemblies 48.

FIG. 2C depicts an alternative embodiment for a flange assembly, which is designated 38'. Annular collars 44, 46 are disposed against radially enlarged flanges 40', 42', respectively, and secured together by a plurality of nut-and-bolt assemblies 48 (one shown). It is noted that the flange assembly 38' may have other constructions as are known in the art. For example, the collars 44, 46 may be split to form two half shells and bolted together or there might be a push fit of one component into another, or screwed or threaded together. Alternatively, the connection between the separation section 20 and the head section 18 might be made permanent.

Figure 2D:
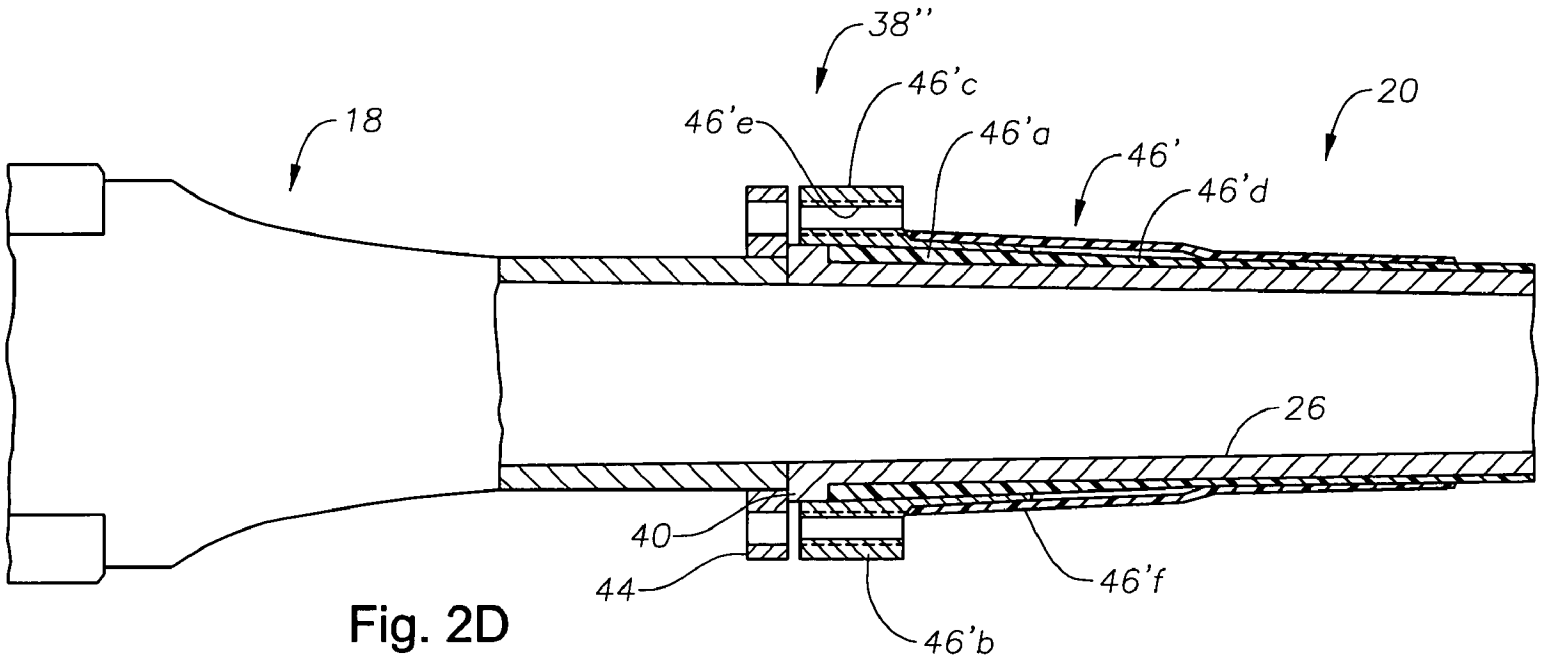
FIG. 2D is a side, cross-sectional view of a further alternative exemplary flange assembly used to secure the head section of a hydrocyclone to the separation portion.

FIG. 2D depicts a further alternative embodiment for the flange assembly, here designated 38". In this embodiment, the sidewall 26 is preferably formed of ceramic. The sidewall 26 is surrounded by a reinforced collar assembly 46'. The collar assembly 46' includes a first, radially inner fiber reinforced layer 46'*a*. The construction of fiber reinforced overlays will be described in detail shortly. It is noted that the radially outer surface of the overlay 46'*a* is tapered so that the end of the overlay 46*a* that lies proximate the flange 40 is diametrically larger than those portions that lie further away from the flange 40. Radially surrounding the first layer 46'*a* is a collar insert 46'*b*, which is preferably fashioned of duplex steel. The collar insert 46'*b* includes a radially enlarged securing portion 46'*c* and a radially reduced sleeve portion 46'*d*. A bolt aperture 46'*e* is disposed through the securing portion 46'*c*. A second fiber reinforced layer 46'*f* radially surrounds the sleeve portion 46'*d* and the first layer 46'*a*. The second layer 46'*f* helps prevent rotation of the collar insert 46'*b* upon the first layer 46'*a*. The two fiber reinforced overlays 46'*a* and 46'*f* merge and become unified at points distal from the flange 40 where the sleeve portion 46'*d* is not disposed between them. The collar assembly 46' may be constructed by first disposing the first fiber reinforced layer 46'*a* upon the sidewall 26. Then, the collar insert 46'*b* is slid up the sidewall from the lower end 31 and secured in place by disposing the second fiber reinforced layer 46'*f* thereupon.

When the separation section 20 is secured to the head section 18, the securing portion 46'*c* lies radially outside of the flange 40 and will be aligned with the collar 44 for attachment thereto with nut and bolt assemblies (not shown). An advantage to this type of flange assembly 38" is that the connection tends to self tighten when tested. In other words, as the hydrocyclone 12 is pulled out of the support plate 16, the collar assembly 46' will tighten up on the taper of sidewall 26, better preventing the head section 18 from pulling away from the separation section 20. The flange assembly 38" is useful for the joining of e.g. a tungsten carbide or treated duplex head section 18 to separation sections fashioned of fiber reinforced epoxy ceramic, such as silicon carbide.

The head section 18 is preferably formed of a highly erosion-resistant material or, alternatively, to provide highly erosion-resistant interior wetted surfaces. In a preferred embodiment, the head section 18 is casted of tungsten carbide. This is preferred for applications where severe erosion of the head section is expected. The head section 18 may also be formed of a suitable ceramic, or other material having similar highly erosion-resistant properties.

In an alternative embodiment, the head section 18 is formed of duplex stainless steel, which has been surface engineered to provide erosion resistance. Surface engineering means providing a coating to, or a modification of, the steel surface to provide greater erosion resistance. A currently preferred coating is formed of micro-sized erosion resistant grains, such as silicon carbide, in a matrix material such as nickel. A currently preferred surface modification involves the carburisation or nitriding of the stainless steel. Alternatively, the stainless steel could be case hardened using physical or chemical methods known in the art to provide improved erosion resistance.

Figure 3:
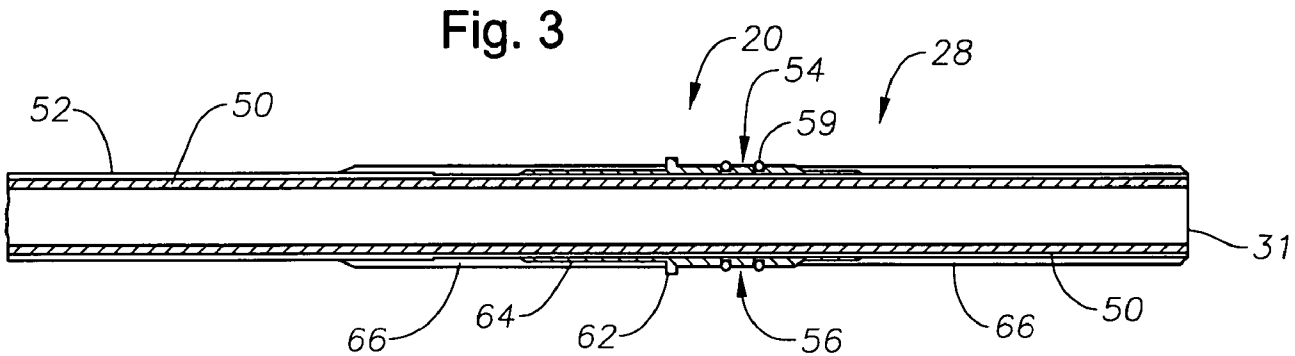
FIGS. 3 and 3A depict a downstream portion of the hydrocyclone assembly shown in FIG. 2 in greater detail.
Figure 3A:
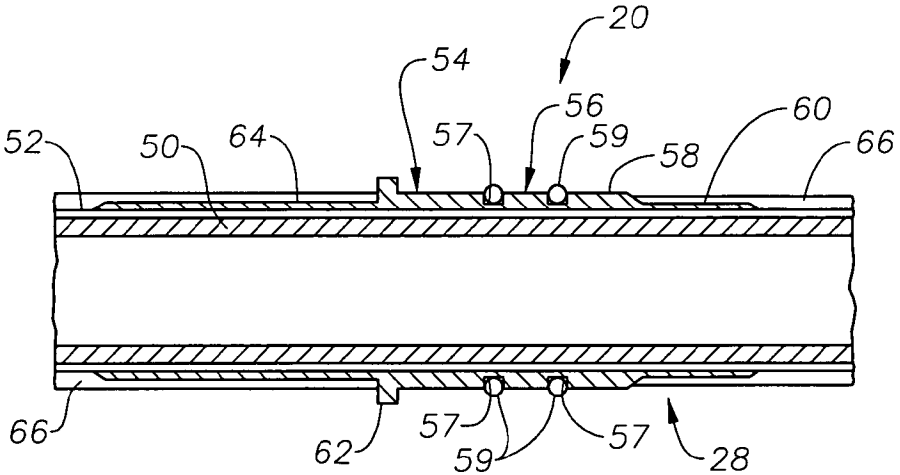

In an alternative embodiment, illustrated in FIGS. 3 and 3A, the underflow portion 28 of the separation section 20 includes a central tubular sleeve 50 fashioned of ceramic. Preferably, the sleeve 50 is formed of a silicon-carbide ceramic but might also be another suitable ceramic, such as alumina ceramic.

The steel tailpipes, whether hardened or coated, are mechanically self supporting, and merely need to be surface treated to achieve erosion resistance. Where it is located in support plate 16 by a welded on trunnion, the sleeve 50 is made of a brittle ceramic material and is surrounded by a first carbon-fiber overlay 52, which provides mechanical support to the sleeve 50, thereby providing the reinforcement portion 35. An extended trunnion 54, typically fashioned of stainless steel, surrounds a portion of the first carbon-fiber overlay 52. The trunnion 54 is fashioned of steel or another durable material and provides a central engagement portion 56 having an outer radial engagement surface 58 that is shaped with a series of gripping recesses 57 that contain elastomeric O-rings 59 to provide a seal with the support plate 16. The engagement portion 56 is the portion of the trunnion 54 that is seated within support plate 16. It is noted that the two O-rings 59 provide a seal between the higher pressure central chamber and the lower pressure underflow chamber of the hydrocyclone vessel 17. The trunnion 54 generally does not contact the inside of the opening in the support plate 16 aside from the O-ring contact. The engagement portion 56 is bounded on either end by a reduced diameter portion 60 and an outwardly projecting annular lip 62. An extended upstream portion 64 extends axially away from the lip 62 in a direction opposite the engagement portion 56. The extended upstream portion 64 has a reduced diameter that is approximately the same as the reduced diameter portion 60. A second carbon-fiber overlay 66 surrounds the first carbon-fiber overlay 52 as well as the reduced diameter portion 60 and extended upstream portion 64 of the trunnion 54. Those portions of the stainless steel trunnion 54 to which the fiber reinforced epoxy is attached (60 and 64) may be roughened (e.g. knurled) to facilitate the gripping of the steel by the epoxy. The reinforced portion 33 may also be provided by one or more overlays of carbon-fiber having the same construction as the overlays 52, 66 and merely wrapped upon the underflow portion 28.

Figure 4:
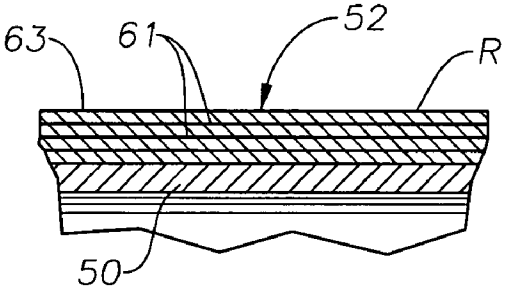
FIG. 4 illustrates the structure of an exemplary reinforcement member.

FIG. 4 illustrates a portion of an exemplary fiber overlay 52 (although overlay 66 has the same structure) disposed upon sleeve 50 to show the use and orientation of fibers 61 within the epoxy 63 of the overlay 52. The fibers 61 are preferably carbon fibers, but might, alternatively be glass fibers of a type known in the art to have comparable tensile strength. This construction is also used for the fiber layers 46'*a* and 46'*f* described earlier. As can be seen, the fibers 61 extend axially along the length of the overlay 52, thereby providing tensile strength and subsequent resistance to bending. The fiber overlays 52, 66 increase tensile strength of the hydrocyclones 12 rendering them less likely to be damaged during installation. In the event of breakage of the sleeve 50, the overlays 52, 56 will also contain fragments of the broken portions. The overlay 52 may be a mat of prepregnated material, of a type known in the art and commercially available, that is wrapped in multiple layers onto the separation section 20 and the lower underflow portion 28 in the manner described to provide reinforced portions 33, 35 or for reinforcement along substantially the entire length of the separation section 20. It is preferred that at least one layer of the overlays 52, 66 have the fibers 61 oriented in the axial direction (as depicted graphically in FIG. 5). If desired, additional layers may be included in the overlays 52, 56 wherein some, but not all, of the fibers 61 are oriented in the axial direction to provide some resistance to torsional forces that might be experienced by the separation section 20 and, especially, the underflow portion 28. Tensile strength provided by the fibers is preferably in the order of 750 Mpa. In other, albeit less preferred embodiments, the reinforced portions 35, 33, 51 may be formed of a sprayed on metal or other composite having suitable mechanical strength to resist bending and lend mechanical strength to the separation section 20. In yet another embodiment, the reinforced portion 51 is provided by encapsulating the sleeve 50 with a molded layer of epoxy that is reinforced with glass spheres. To accomplish this, the sleeve 50 is placed in a mold and the epoxy poured in around the sleeve 50 and then cured thereupon.

Figure 5:
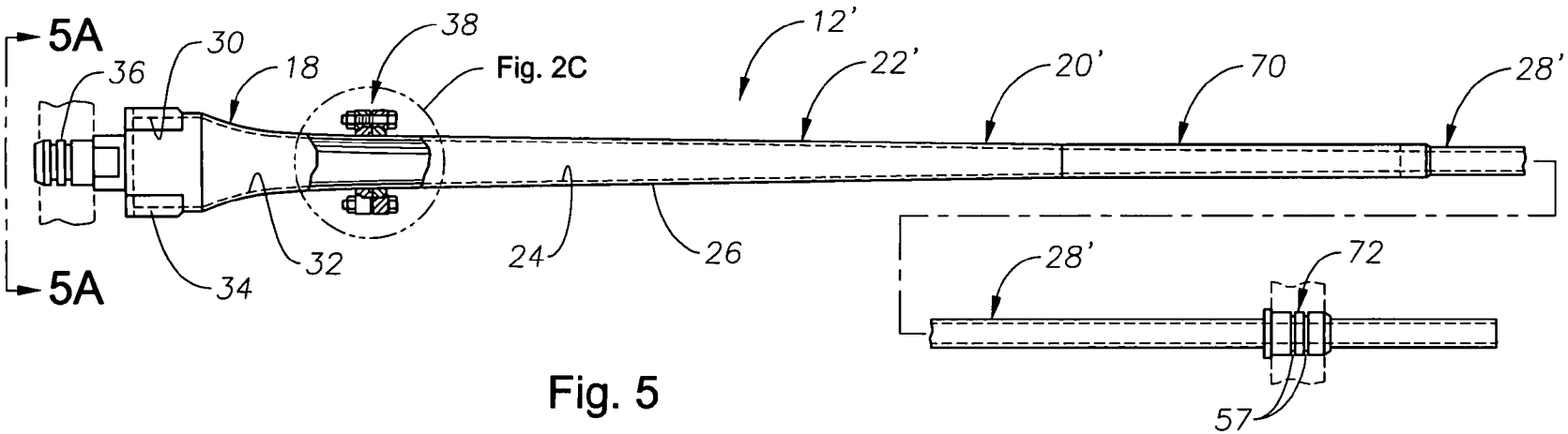
FIGS. 5 and 5A illustrate an alternative exemplary erosion-resistant liquid/liquid separation hydrocyclone constructed in accordance with the present invention.
Figure 5A:
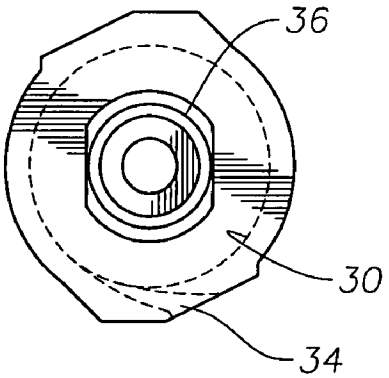
Figure 6:
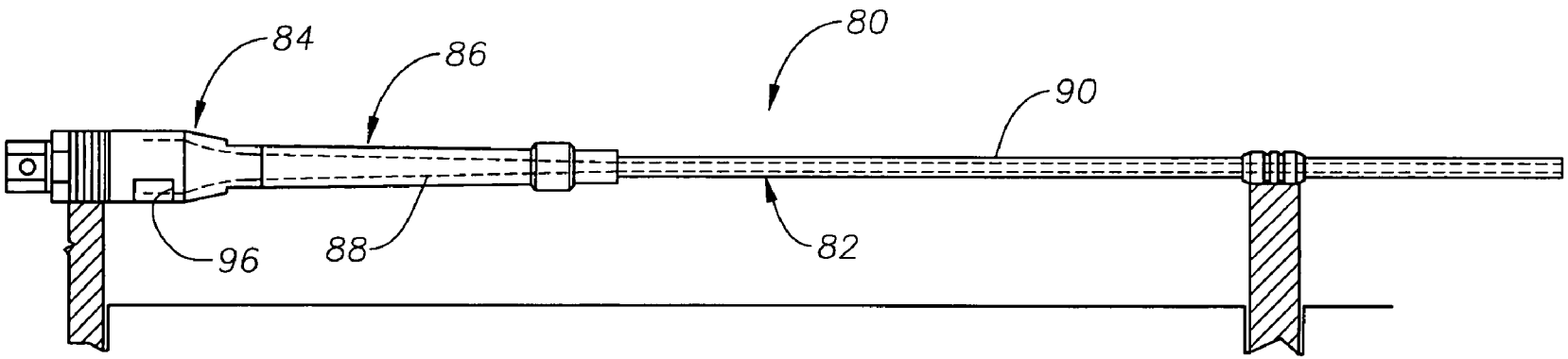
FIG. 6 depicts a further alternative exemplary erosion-resistant liquid/liquid separation hydrocyclone constructed in accordance with the present invention.
Figure 7:
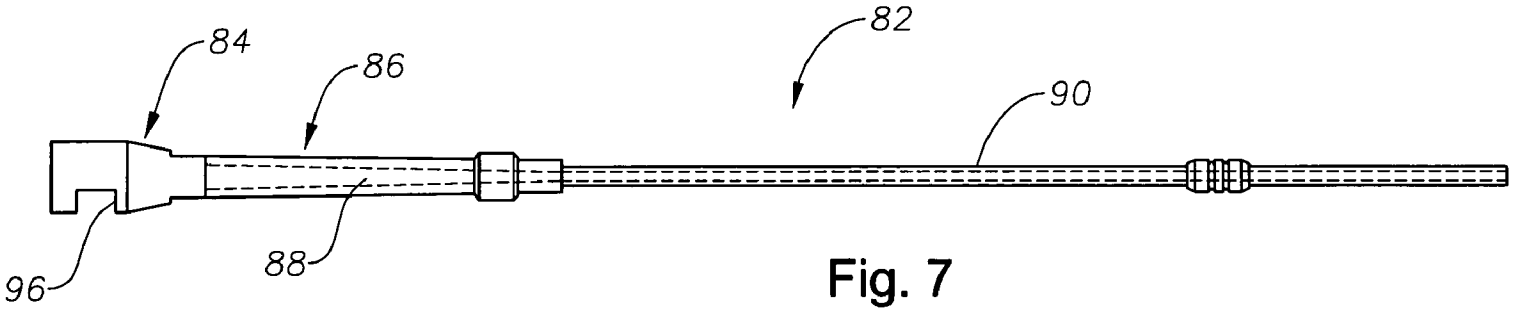
FIG. 7 depicts the outer chassis portion of the hydrocyclone shown in FIG. 6.
Figure 9:
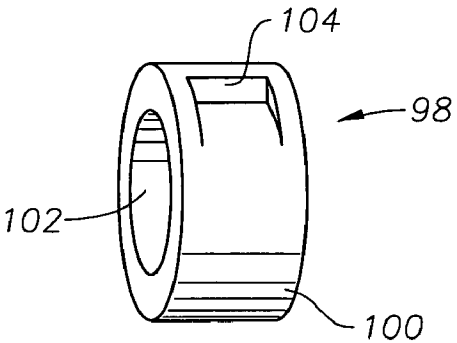
FIG. 9 illustrates an exemplary removable involute component.
Figure 8:
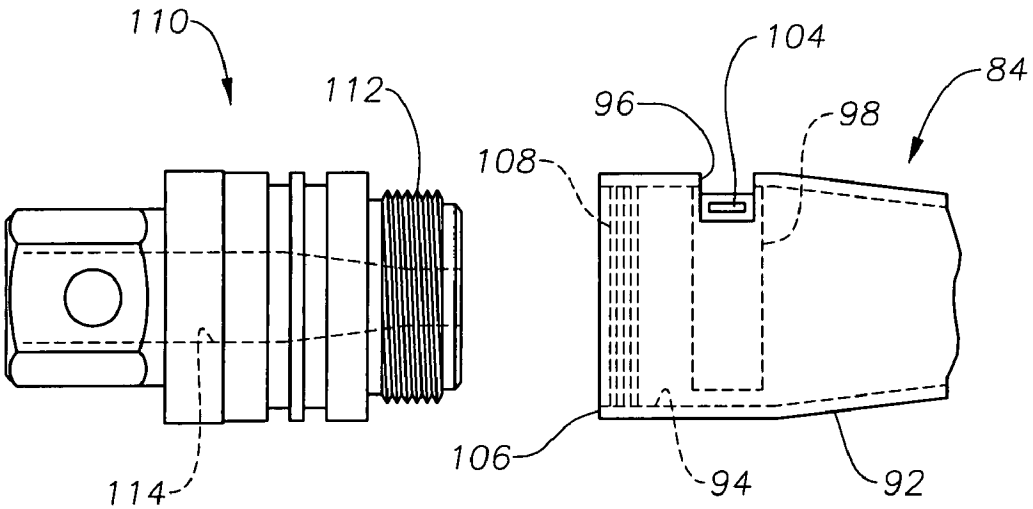
FIG. 8 illustrates a reject gallery portion of the hydrocyclone shown in FIG. 6.

An alternative embodiment for the construction of the separation section 20' is illustrated in FIGS. 5 and 5*a*, which shows a hydrocyclone 12'. In this embodiment, the upper portion 22' and the underflow portion 28' of the separation section 20' are formed as separate components and joined together by a joint 70. The joint 70 is a tubular member having a thickened sidewall to provide additional support against bending proximate the middle portions of the hydrocyclone 12'. A metallic trunnion 72 surrounds a lower portion of the underflow portion 28' and serves to engage the support plate 16, thereby protecting the underflow portion 28' from significant bending stresses that might be imposed by the support plate 16.

The hydrocyclones 12 and 12' provide improved erosion-resistance. Potential uses for the hydrocyclones 12, 12' include the separation of hydrocarbon fluids or chemicals that contain amounts of sand or other small solid particles that are desirable to remove. Improved erosion-resistance is provided for the head section 18 through the use of highly erosion-resistant materials such as tungsten carbide. At the same time, there is little or no sacrifice in the mechanical robustness of the hydrocyclone 12 or 12' overall since the lengthy separation portion 20 is constructed primarily of less brittle material, such as hardened duplex stainless steel. If increased erosion resistance is required in the tail pipes 20 and 28, more brittle material if suitable supported by, for instance, carbon fiber epoxy.

As is known in the art, a fluid or fluid/solid mixture is introduced into the hydrocyclone 12 or 12' at the inlets 34. The entering fluid mixture forms a circular flow along the inside of the separation chamber 30, and the centrifugal force created separates the liquid mixture with the denser fraction on the sides of the separation chamber 24 and a less dense fraction in the core of the separation chamber 24. The denser fraction exits the separation chamber at the underflow end 28, 28' of the hydrocyclone 12, 12', and the less dense fraction exits the separation chamber at the overflow end. The individual hydrocyclone underflows empty into the common underflow chamber. Similarly, from the overflow (reject) end of the hydrocyclones, the less dense fraction empties into a common overflow or reject chamber in the hydrocyclone assembly 10.

A significant advantage to having a separable head section 18 is that the separation sections 20, 20' of the hydrocyclone 12 or 12' may be removed and replaced from the assembly 10 without having to remove and replace the head section 18. Similarly, the head section 18 may be removed or replaced from the assembly 10 without having to remove or replace the separation sections 20 or 20'. The head sections 18 and separation sections of different hydrocyclones may be mixed and matched as well.

FIGS. 6, 7, 8 and 9 illustrate a further alternative hydrocyclone 80, which features a removable reject gallery and involute portion. The hydrocyclone 80 includes a chassis 82, which is shown apart from other components in FIG. 7. The chassis 82 is fashioned of hardened duplex stainless steel and consists of a head section 84 and an affixed separation section 86 having an upper separation chamber section 88 and an underflow, or tailpipe, portion 90. The structure of the head section 84 is best understood by reference to FIG. 8, which shows the head section 84 including a housing 92 that defines a component chamber 94 therein. A lateral window 96 is cut through the housing 92. Although only one window 96 is depicted, it will be understood that there may be two diametrically opposed windows 96 in the housing 92, if desired. A removable involute insert 98 resides within the component chamber 94. The involute insert 98 is shown apart from the other components in FIG. 9 and consists of a cylindrical body 100 having a central axial opening 102 and one or more lateral fluid inlets 104. The body 100 of the insert 98 is made of a highly erosion resistant material, such as tungsten carbide. When the insert 98 is seated in the component chamber 94, the fluid inlet 104 is aligned with the window 96 of the housing 92 so that fluid may enter the inlet 104 through the window 96. The open end 106 of the housing 92 contains threading 108. A reject chamber component 110 has complimentary threads 112 and can be removably connected to the housing 92 via threaded connection. The reject chamber component 110 is fashioned of hardened stainless steel and contains flow passages 114 for the removal of fluid from the hydrocyclone 80. The head section 84 is assembled by inserting the insert 98 within the component chamber 94 and then securing the reject chamber component 110 to the housing 92. O-rings and other seals known in the art may be used to ensure a fluid tight seal.

It is noted that a highly erosion resistant material (e.g., tungsten carbide) is used for the involute insert 98 while the other portions need not be and preferably are instead fashioned from a more durable stainless steel, which is then hardened, coated, or otherwise surface engineered. Fluid entering the hydrocyclone 80 via inlets 104 will encounter an involute chamber, formed primarily by the central axial opening 102 of the insert 98 which will provide superior erosion resistance. If required, an erosion-resistant insert can be fitted inside separation chamber section 88. Alternatively, the separation chamber section 88 may be made entirely of an erosion resistant material, such as ceramic or tungsten carbide or another material with a greater erosion resistance than stainless steel. The tailpipe 90 can be silicon carbide, connected to separation chamber 88 using a fiber-reinforced epoxy, as previously described.

A further advantage of the design of the hydrocyclone 80 is that the insert 98 may be easily and inexpensively replaced when it has become worn. This is accomplished by first unthreading and removing the reject chamber component 110 from the housing 92 and then withdrawing the worn insert 98 from the open end 106 of the housing 92.

Those of skill in the art will recognize that numerous modifications and changes may be made to the exemplary designs and embodiments described herein and that the invention is limited only by the claims that follow and any equivalents thereof.

What is claimed is:

1. A liquid/liquid hydrocyclone liner comprising:

a head section having a fluid inlet and overflow outlet, the head section providing an involute formed primarily of a first material having a first resistance to erosion;

a separation section having an underflow outlet, the separation section being formed primarily of a second material having a second resistance to erosion; and wherein the first resistance to erosion is generally greater than the second resistance to erosion.

2. The hydrocyclone liner of claim 1 wherein the head section and separation section are removably affixed to one another.

3. The hydrocyclone liner of claim 1 further comprising a reinforcement layer disposed upon the separation section.

4. The hydrocyclone liner of claim 3 wherein the reinforcement layer is comprised of a fiber-reinforced epoxy.

5. The hydrocyclone liner of claim 4 wherein the fiber-reinforced epoxy is reinforced with carbon fibers.

6. The hydrocyclone liner of claim 4 wherein the fiber-reinforced epoxy is reinforced with glass fibers.

7. The hydrocyclone liner of claim 4 wherein the fiber-reinforced epoxy contains a plurality of fibers that are disposed axially within the epoxy to provide resistance to bending of the separation section.

8. The hydrocyclone of claim 3 wherein the reinforcement layer is formed of a sprayed on material.

9. The hydrocyclone liner of claim 1 wherein the separation section comprises a pair of tubular portions that are interconnected by a tubular joint member.

10. The hydrocyclone liner of claim 1 wherein the first material comprises tungsten carbide.

11. The hydrocyclone liner of claim 1 wherein the first material comprises silicon carbide.

12. The hydrocyclone liner of claim 1 wherein the second material comprises ceramic.

13. The hydrocyclone liner of claim 1 wherein the second material comprises surface engineered stainless steel.

14. The hydrocyclone liner of claim 13 wherein the second material is surface engineered by case hardening.

15. The hydrocyclone liner of claim 13 wherein the second material is surface engineered by coating.

16. A liquid/liquid hydrocyclone liner comprising:

a head section having a fluid inlet and overflow outlet and a separation section having an underflow outlet, the separation section being removably affixed to the head section, wherein the head section is formed of a material that provides a greater erosion resistance than that provided by the separation section.

17. The hydrocyclone liner of claim 16 further comprising an external structural support for the separation section.

18. The hydrocyclone liner of claim 16 wherein the head section is substantially formed of tungsten carbide.

19. The hydrocyclone liner of claim 16 wherein the head section is substantially formed of silicon carbide.

20. The hydrocyclone liner of claim 16 wherein the separation section is substantially comprised of a stainless steel duplex material.

21. The hydrocyclone liner of claim 16 wherein the head section and the separation section are removably affixed by a flange assembly.

22. The hydrocyclone liner of claim 17 wherein the structural support comprises a sleeve formed of a fiber-reinforced epoxy.

23. The hydrocyclone liner of claim 17 wherein the structural support comprises a tubular joint that interconnects portions of the separation section.

24. A liquid/liquid hydrocyclone liner comprising:

a head section having a fluid inlet and overflow outlet, the head section containing an involute being substantially formed of a highly erosion-resistant first material; and a separation section having an underflow outlet, the separation section being formed of a second material that is more physically resistant to bending and impacts than the first material, the second material having a resistance to erosion less than the resistance to erosion of the first material.

25. The hydrocyclone liner of claim 24 wherein the separation section is removably affixed to the head section.

26. The hydrocyclone liner of claim 24 wherein the first material comprises tungsten carbide and the second material comprises hardened stainless steel duplex.

27. The hydrocyclone liner of claim 24 wherein the head section contains a removable involute insert formed of highly erosion resistant material.

* * * * *